United States Patent [19]

Jackson

[11] Patent Number: 4,715,328

[45] **Date of Patent: * Dec. 29, 1987**

[54] MULTIPLE PISTON EXPANSION CHAMBER ENGINE

[76] Inventor: Francis W. Jackson, 409 Penwyn Rd., Wynnewood, Pa. 19096

[ * ] Notice: The portion of the term of this patent subsequent to Apr. 8, 2003 has been disclaimed.

[21] Appl. No.: 787,493

[22] Filed: Oct. 15, 1985

Related U.S. Application Data

[60] Continuation-in-part of Ser. No. 727,338, Apr. 25, 1985, abandoned, and Ser. No. 688,954, Dec. 31, 1984, Pat. No. 4,570,580, and Ser. No. 647,842, Sep. 6, 1984, Pat. No. 4,580,532, which is a division of Ser. No. 326,902, Dec. 2, 1981, Pat. No. 4,489,681, said Ser. No. 688,954, Continuation-in-part of Ser. No. 326,902, and Ser. No. 647,842, is a division of Ser. No. 326,902, , said Ser. No. 727,338, is a division of Ser. No. 647,842, , which is a division of Ser. No. 326,902.

[51] Int. Cl.[4] ..... F02B 75/18

[52] U.S. Cl. ..... 123/52 B; 123/53 R

[58] Field of Search ..... 123/52 B, 53, 312

[56] References Cited

U.S. PATENT DOCUMENTS

| | | | |
|---|---|---|---|
| 1,238,222 | 8/1917 | Tillotson | 123/312 |
| 1,241,999 | 10/1917 | Learned | 123/53 AA |
| 1,309,891 | 7/1919 | Griffith | 123/52 B |
| 4,580,532 | 4/1986 | Jackson | 123/52 B |

FOREIGN PATENT DOCUMENTS

| | | | |
|---|---|---|---|
| 901605 | 1/1954 | Fed. Rep. of Germany | 123/52 B |

*Primary Examiner*—Craig R. Feinberg

[57] ABSTRACT

Multiple expansion chambers are configured to partially expand the combusted charge in the combustion chamber and then to complete the expansion process using a supplemental expansion chamber with chamber isolation designs.

4 Claims, 12 Drawing Figures

MULTIPLE PISTON EXPANSION CHAMBER ENGINE

This is a continuation-in-part application to patent application Ser. Nos. 727,338, filed 4/25/85, now abandoned; 688,954, filed 12/31/84, now U.S. Pat. No. 4,570,580; and 647,842, filed 9/6/84, now U.S. Pat. No. 4,580,532; which is a divisional of application No. 326,902, filed 12/2/81, now U.S. Pat. No. 4,489,681. Application Ser. No. 688,954 is a continuation-in-part of application Ser. No. 326,902, now U.S. Pat. No. 4,489,681, and application Ser. No. 647,842, filed 9/6/84, now U.S. Pat. No. 4,580,532, which is a divisional of application No. 326,902, now U.S. Pat. No. 4,489,681. Application Ser. No. 727,338 is a divisional of application Ser. No. 647,842, now U.S. Pat. No. 4,580,532, which is a divisional of application Ser. No. 326,902, now U.S. Pat. No. 4,489,681.

DESCRIPTION OF PRIOR ART

In prior art the balance of many factors has led to cylinder designs with stroke to bore's around 1. Given this stroke to bore and an average piston speed the engine efficiency and weight for a given cylinder horsepower is pretty well set.

SUMMARY

The use of multiple expansion chambers configured to partially expand the combusted charge in the combustion chamber and then to complete the expansion process using a supplemental expansion chamber with chamber isolation designs that when allowing communication between these chambers accomplish the communication with minimal throttling and minimum added wetted perimiter provides attractive improvements.

The smaller diameter initial chamber allows flame speed to not be as restrictive on stroke to bore. This permits, for flame speed considerations, smaller stroke to bore's to be used. Lower stroke to bore's are not accompanied by significantly increased friction losses as only the combustion chamber sees peak chamber pressure while the auxilary chamber(s) with significantly reduced peak pressure requires smaller bearings. Engine heat transfer losses are down. The net result is increased engine efficiency at reduced weight.

BRIEF DESCRIPTION OF DRAWINGS

FIG. 1 shows a cam driven (cam not shown) thin auxiliary piston 400 acting primarily as a valve between the center cylinderical working piston 401 and the outer auxiliary piston 402. Center reciprocating working piston 401 with piston rings 411 and oil ring 412 sealing between said piston 401 and cylinderical wall 413 in which piston 401 moves as it is driven by rotating crank 414 through rod 415 and wrist pin 416. Rod 415 connected to the wrist pin 416 through bearing 417 and to crank 414 through bearing 418. Rotating crank 414 is held by working bearings 440.

Figure 1:
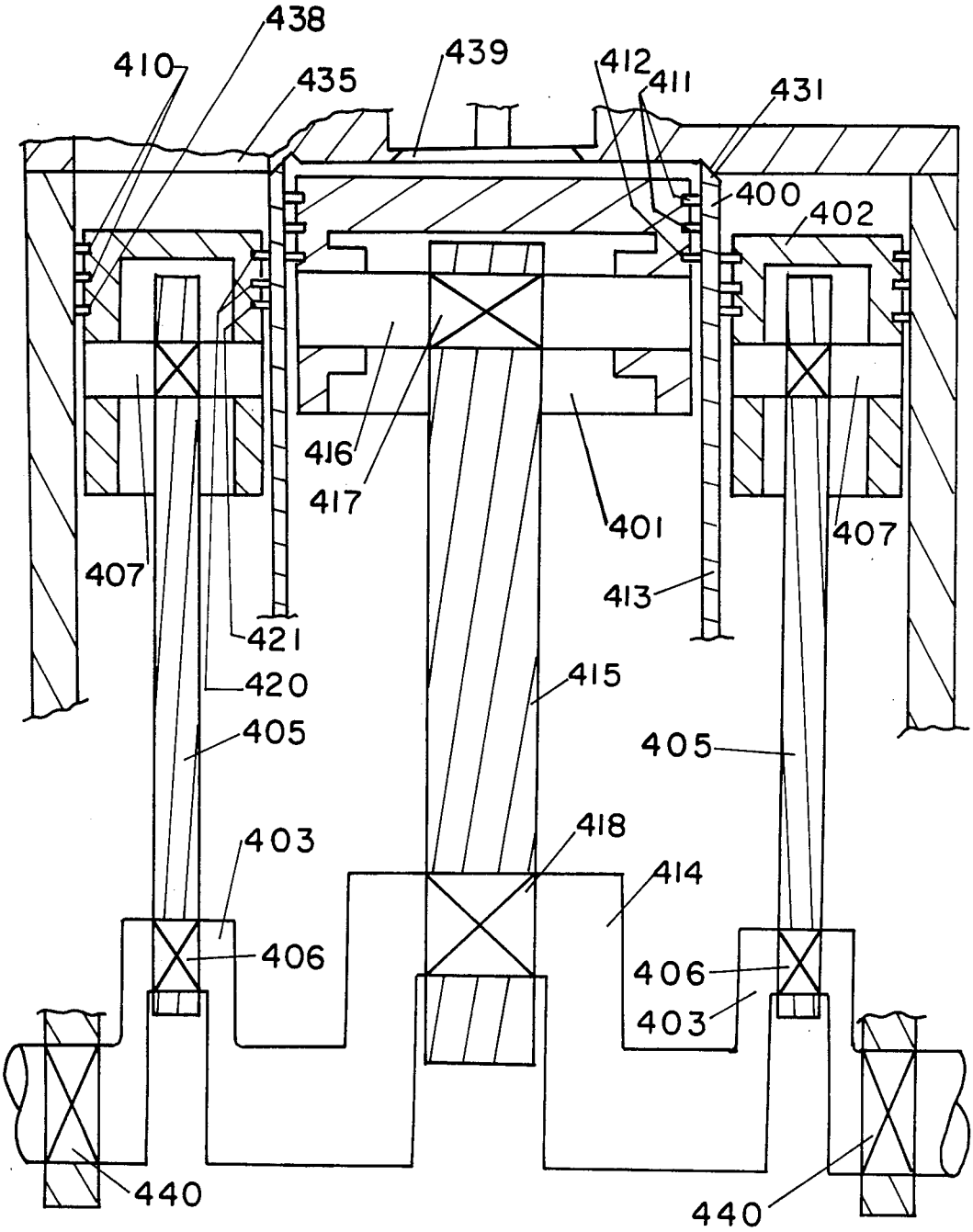
FIG. 1 is a form of the engine combustion, expansion and exhaust chamber wherein both working and auxiliary pistons are crank driven at the same RPM.

Valve 400 with piston rings 420 and oil ring 421 sealing the outer circumference of valve 400 and the auxiliary piston 402 in which auxiliary valve 400 moves driven by cam mechanism (not shown) reciprocating auxiliary valve 400 and at TDC circular mating surface 431 of auxiliary valve 400 seal against the mating surface. Twin cranks 403 also on the working crank operating in unison through crank bearings 404 which drive rods 405 through bearings 406 and wrist pin 407, reciprocate auxiliary piston 402 sealed against the outer cylinderical wall 409 through rings 410 and oil seal ring 438. Inlet valve 439 opens about when valve 400 closes and with piston 401 at about TDC. Carbureated charge is forced into the chamber from a pressurized supply or forced in by a properly phased (charging piston at about TDC at about when the inlet valve to the main chamber closes) piston. An exhaust only valve (not shown) located above the auxiliary piston 402 commutating to the exhaust manifold during exhaust and closed at all other times. Spark plug ignites the combustable mixture about the time inlet valve 439 closes.

Figure 2A:
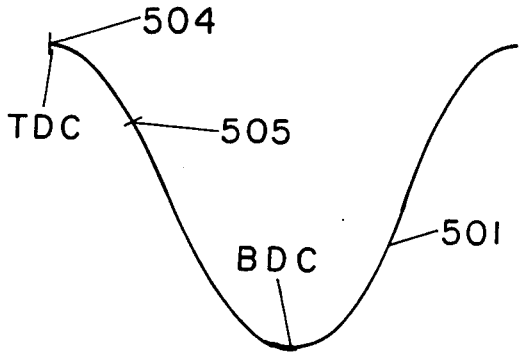
FIGS. 2 A, B and C show timing relationships for FIG. 1.
Figure 2B:
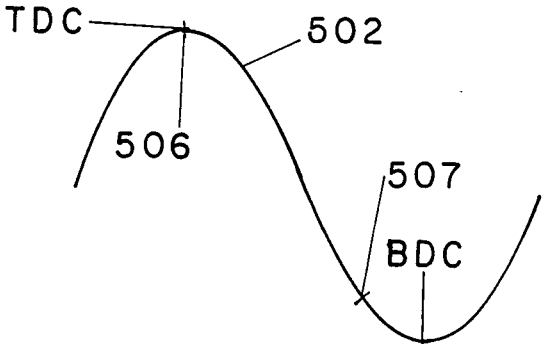
Figure 2C:
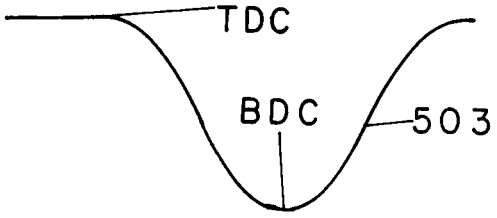

FIGS. 2 A, B and C presents representative displacements of a working circular piston, an auxiliary annular piston and the auxiliary valve. The exhaust and inlet openings and ignition timing for the configuration defined in FIG. 1 during the intake, combustion, expansion and exhaust of the working chamber chamber. FIG. 1A deplicts the displacement 501 of the working piston as it moves between TDC and BDC. The inlet valve opens at 504 and closes at 505 inlet port opens at about the working piston TDC and continues until the working piston is between 20 and 90 (FIG. 2C shows a 40 degree point for illustrative purposes the exact timing is dependent on a number of design choices) degrees past TDC at which time the inlet valve 439 closes. Ignition occurs about or prior to the sealing of the inlet 505. During the time said inlet is open the pressurized charge flows into the working chamber. Said charge being pressurized by suitable means with (compressor) or without (charging piston properly phased to the working piston e.g., reaching TDC at about 505) plenum. FIG. 2B deplicts the auxiliary piston motion. The exhaust valve opens at 507 and remains open until 506 on the following cycle. 506 being at about the time the inlet to the working piston closes 505. Figure 2C deplicts the auxiliary valve motion. The auxiliary valve seals at about 504 (see FIG. 2A). Said auxiliary valve and head remaining sealed from when the working piston is at about TDC (504) until charging and partial movement toward BDC by the center working piston. At a point 0 to 120 degrees after inlet valve 439 closure, the cam mechanism moves the auxiliary valve away from the head breaking the seal and permitting combustion products to flow from the chamber above the working piston into the chamber above the auxiliary piston and both the working and auxiliary pistons now combine to provide expansion.

Figure 3:
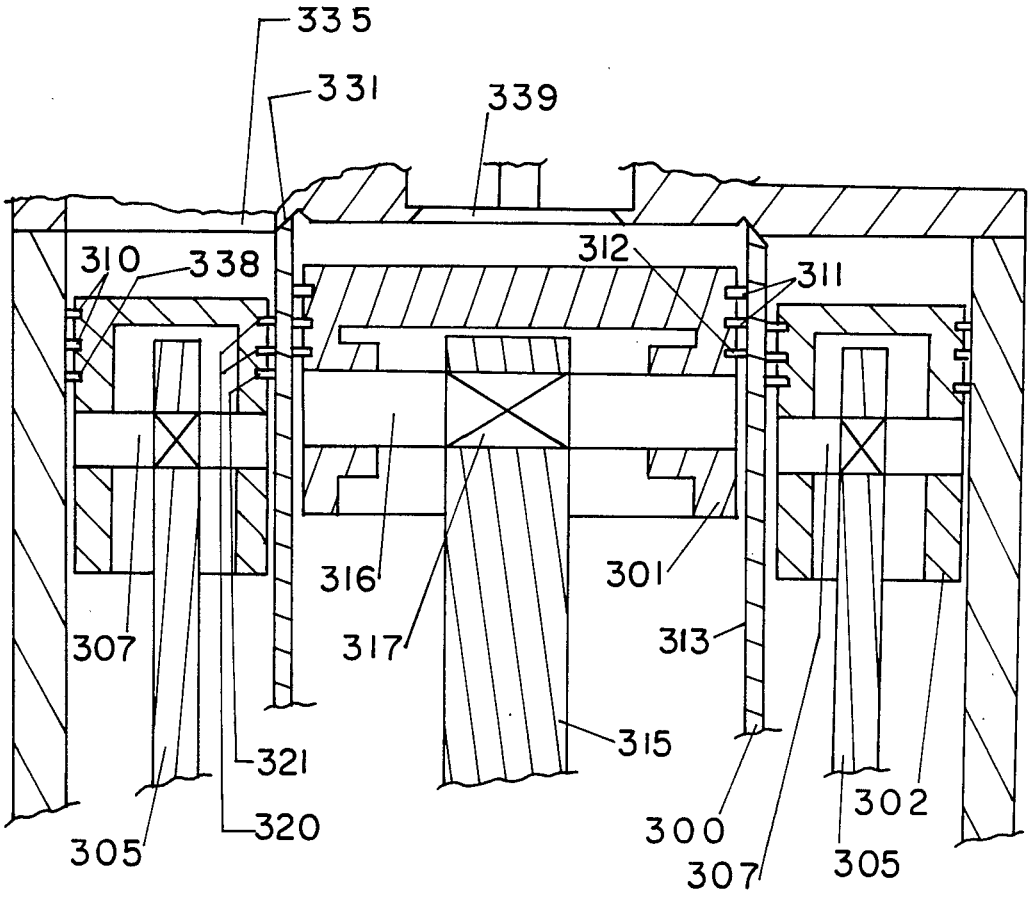
FIG. 3 is a form of the engine wherein the working chamber is driven at twice the RPM of the auxiliary piston.

FIG. 3 shows a cam driven (cam not shown) thin auxiliary piston 300 acting primarily as a valve between the center cylinderical working piston 301 and the outer auxiliary piston 302. Center reciprocating working piston 301 with piston rings 311 and oil ring 312 sealing between said piston 301 and cylinderical wall 313 in which piston 301 moves as it is driven by rotating crank 314 through rod 315 and wrist pin 316. Rod 315 connected to the wrist pin 316 through bearing 317 and to crank 314 through bearing 318. Rotating crank 314 is held by working bearings 340.

Valve 300 with piston rings 320 and oil ring 321 sealing the outer circumference of valve 300 and the auxiliary piston 302 in which auxiliary valve 300 moves driven by cam mechanism (not shown) reciprocating auxiliary valve 300 and at TDC circular mating surface 331 of auxiliary valve 300 seal against the mating surface. Twin cranks 303 also on the working crank operating in unison through crank bearings 304 which drive rods 305 through bearings 306 and wrist pin 307, reciprocate auxiliary piston 302 sealed against the outer cylinderical wall 309 through rings 310 and oil seal ring 338. Inlet valve 339 opens about when valve 300 closes and with piston 301 at about TDC. Carbureated charge is forced into the chamber from a partially pressurized supply or forced in by a properly phased (charging piston at about TDC at about when the inlet valve to the main chamber closes) as the working piston withdraws to BDC and returns toward TDC. Inlet valve 339 closing shortly after the working piston passes BDC (as in normal engine inlet timing e.g., approximatly 215 degrees after TDC). Working piston fully compresses the charge and prior to TDC a spark ignites the mixture. The working piston passes TDC and withdraws toward BDC. At between 20 degrees past TDC and 170 degrees past TDC and with the auxiliary piston at about its TDC auxiliary valve 300 opens allowing the combusted charge to communicate from the working piston chamber to the auxiliary piston chamber. An exhaust only valve (not shown) located above the auxiliary piston 302 commutating to the exhaust manifold during exhaust and closed at all other times.

Figure 4A:
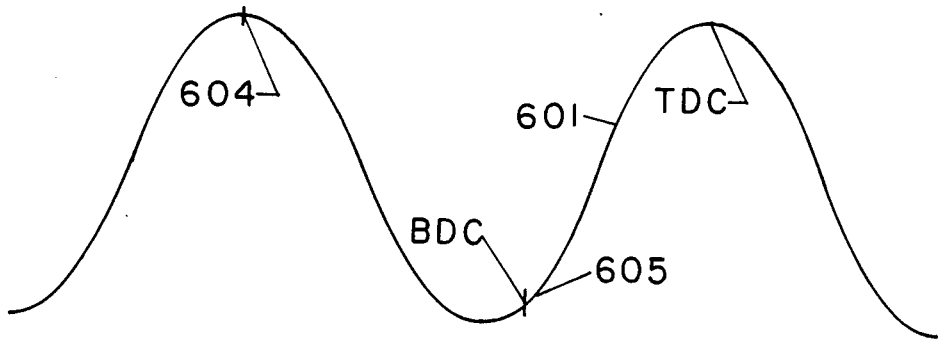
FIGS. 4 A, B and C show timing relationships for the FIG. 3.
Figure 4B:
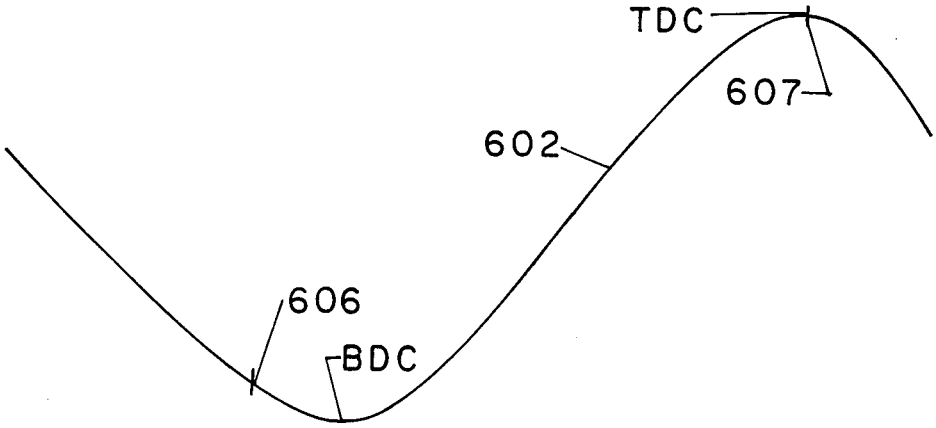
Figure 4C:
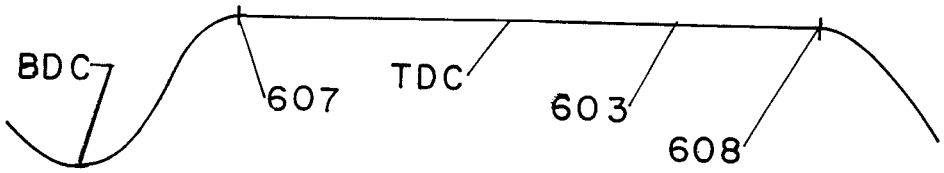

FIGS. 4A, B and C presents representative cycle displacements of a working and auxiliary piston, the exhaust and inlet openings and ignition timing for the configuration defined in FIG. 3. Note the working piston revolves 2 revolutions to each one of the auxiliary piston. Also the FIG. 3 mechanization is modified to provide for the proper volume in the working chamber when the working piston is at TDC. FIG. 4A deplicts the displacement 601 of the working piston as it moves between TDC and BDC. The inlet valve opens at 604 and closes at 605. During the time said inlet is open the partially pressurized charge flows into the working chamber. Said charge being partially pressurized by suitable means with (compressor) or without (charging piston properly phased to the working piston e.g., reaching TDC at about 605) plenum. FIG. 4B deplicts the auxiliary piston motion at half working piston RPM. The exhaust valve opens at 606 and remains open until 607. FIG. 4C deplicts the auxiliary valve motion. The auxiliary valve seals 607 at about 604 and remains sealed 608 until about 607 at which point the auxiliary valve withdraws permitting communication between the working and auxiliary chambers until 607 of the following cycle. Exhaust port uncovers as the auxiliary piston approaches BDC, inlet port opens at about the working piston TDC and continues until the working piston is after BDC. Timing shown is for illustrative purposes the exact timing of 608 during the expansion stroke of the working piston is dependent on a number of design choices. Ignition occurs about or prior to the working piston arriving at TDC near the end of it's compression stroke. At a point after ignition and after the working piston during it's expansion stroke has moved 20 degrees from TDC and before it has moved 170 degrees past TDC, the cam mechanism moves the auxiliary valve away from the head breaking the seal and permitting combustion products to flow from the chamber above the working piston into the chamber above the auxiliary piston and both the working and auxiliary pistons now combine to provide expansion.

Figure 5:
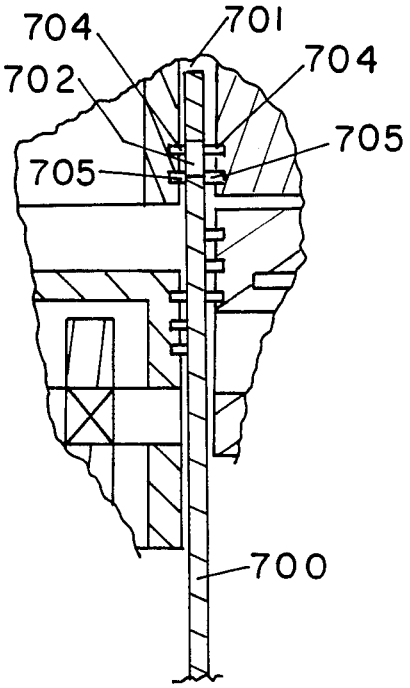
FIG. 5 shows an alternative auxiliary valve arrangement based on a 2 stroke port valve approach.

FIG. 5 is a partial view of the figure 3 configuration with the auxiliary valve based on 2 stroke engine port valve design with auxiliary valve 700 projecting into head cavity 701 and with valve ports 702 spaced circumferentially around the auxiliary valve such that the position of the auxiliary valve controls communication between the working and auxiliary chambers. The position of said auxiliary valve is controlled by a cam mechanism or by properly phased crank designs. With ring seals about the auxiliary valve inner and outer surfaces at the top 703 to prevent leakage into the head cavity 701 and seal at 705 to 703 to prevent leakage into the head cavity 701 and seal at 705 to prevent leakage from the main chamber to the ports when the ports are in the cavity above seal 705

Figure 6:
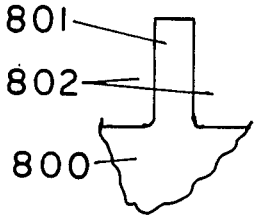
FIG. 6 shows a modified 2 stroke valve based valve with the upper structure removed such that the valve additionally functions as a piston.

FIG. 6 is a further refinement of the FIG. 5 auxiliary valve wherein the upper portion 802 of the auxiliary valve 800 is removed having the auxiliary valve 800 additionally functioning as a piston while also reducing minimum volume and minumum surface inpacts of the auxiliary valve. Multiple extensions 801 of the upper portion 800 are left to maintain the rings (not shown) properly compressed and positioned. Again this valve comfiguration can be cam or crank driven.

Figure 7:
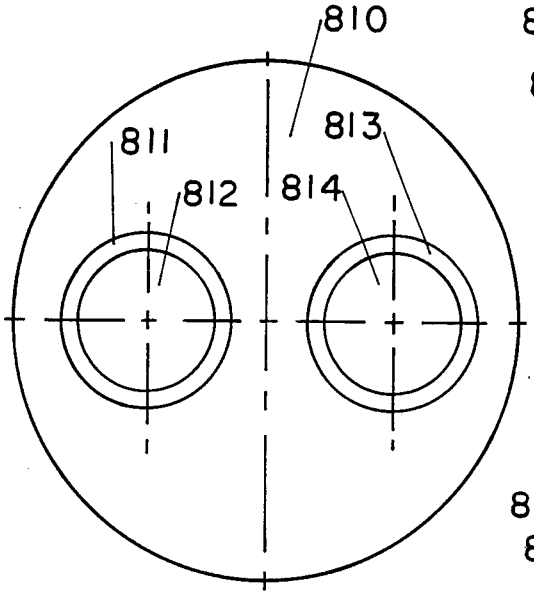
FIG. 7 shows two working pistons within a single auxiliary piston.

FIG. 7 shows two working pistons 812 and 814 with their respective auxiliary valves 811 and 813 within a single auxiliary piston 810. This frees up the center of the auxiliary piston for crank application at the center-of-pressure. Note: imbalanced force application from the two working pistons will require an anti twisting bearing for the auxiliary piston. The multiple working pistons may fire in unison in an application similar to FIG. 1 or they may fire on alternative working piston RPM's in an application similar to FIG. 3 permitting the auxiliary piston to turn at the same RPM as the working pistons and therefor drivable from the same crankshaft as the working pistons.

Figure 8:
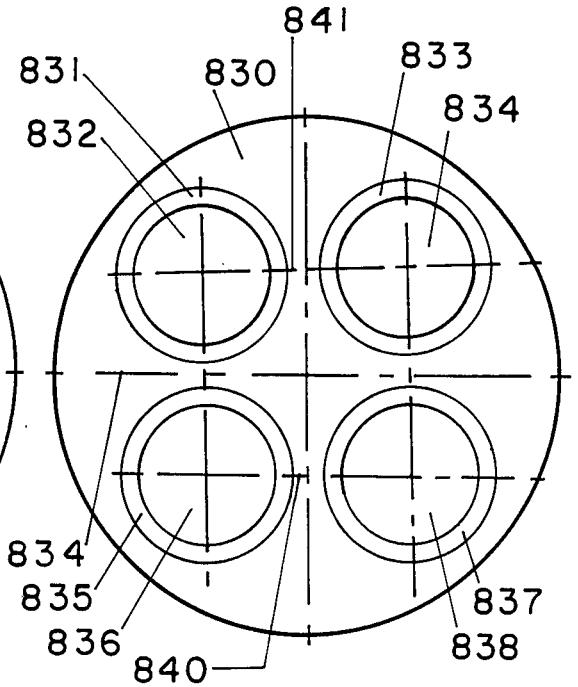
FIG. 8 shows four working pistons within a single auxiliary piston.

FIG. 8 utilizes four working pistons within a single auxiliary piston thereby increasing the available percent of the auxiliary surface usable for working pistons while maintaining the auxiliary piston center open for single crank driven design (note: again twisting must be addressed). The design flexibility of four pistons provides a number of options with various pluses and minuses: (1) all may work in unison as in a FIG. 1 application and even slightly phased if desired, (2) They may fire on alternative working piston RPM's in pairs as in an application similar to FIG. 3 with 3 combinations of pairs to choose from i.e., 832 and 834 together (on the same RPM) or 832 and 836 together or 832 and 838 together. While all five pistons can be driven by a single crank near center-line 834 the design is a natural for dual crank designs with cranks at center-lines 840 and 841 driving their respective working pistons and jointly driving the auxiliary piston—— or only one need drive the auxiliary piston, or a third crank could be employed to drive the auxiliary piston.

It is also pointed out that:

(1) where a charging piston is employed said charging piston can employ a reverse of the expanding piston concept to compress in both pistons with the final compression done in one chamber to limit the minimum trapped volume at a given clearance of the charging chamber.

(2) configurations may utilize working piston(s) external to the auxiliary piston as well as internal to it.

(3) different auxiliary valve types such as poppet types between the working and auxiliary chambers may be employed.

(4) while spark ignition engines are discribed the discription and the claims apply equally to CI engines.

I claim:

1. An internal combustion engine wherein combustion, expansion and exhaust functions are performed in a cylinder comprised of an auxiliary piston reciprocating in the cylinder, a sleeve valve reciprocating within said auxiliary piston, a working piston reciprocating within said sleeve valve and leading said auxiliary piston, an auxiliary chamber above said auxiliary piston and a combustion chamber above said working piston; said sleeve valve controlling communication of said auxiliary chamber with said combustion chamber to prevent communication of combusted products from the chamber above said working piston to the chamber above said auxiliary piston from when the working piston is at about TDC until a subsequent expansion stroke of said working piston is underway and at a point between 30 and 160 degrees past TDC and with said auxiliary piston being at about TDC at this same instant when said working piston is at said point and said communication then is commenced; and to permit communication only during said expansion stroke continuing past said point and a following exhaust stroke of said working piston so as to utilize energy of expansion from said auxiliary piston as it expands until said working piston has passed through BDC and returns to about TDC during said exhaust stroke of said working piston.

2. An internal combustion engine according to claim 1: wherein said communication controlling means comprises a sealing surface on a surface of said (auxiliary) sleeve valve adjacent said working piston.

3. An internal combustion engine according to claim 1: wherein said communication controlling means comprises a circular sealing surface on an (upper) upward viewing surface of said auxiliary valve adjacent said working piston.

4. An internal combustion engine according to claim 1: wherein said sleeve valve is around said working piston sealing on inner surface of said sleeve valve adjacent said working piston with multiple sleeve valve projections to contain rings as the sleeve valve is withdrawn during communication.

* * * * *